US010600365B2

(12) United States Patent
Jeong et al.

(10) Patent No.: US 10,600,365 B2
(45) **Date of Patent: *Mar. 24, 2020**

(54) PIXEL AND ORGANIC LIGHT EMITTING DIODE DISPLAY HAVING A BYPASS TRANSISTOR FOR PASSING A PORTION OF A DRIVING CURRENT

(71) Applicant: Samsung Display Co., Ltd., Yongin-si, Gyeonggi-do (KR)

(72) Inventors: Jin-Tae Jeong, Yongin-si (KR); Won-Kyu Kwak, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/669,719

(22) Filed: Aug. 4, 2017

(65) Prior Publication Data

US 2017/0330515 A1 Nov. 16, 2017

Related U.S. Application Data

(63) Continuation of application No. 15/136,721, filed on Apr. 22, 2016, now Pat. No. 9,728,134, which is a (Continued)

(30) Foreign Application Priority Data

Feb. 7, 2012 (KR) ..... 10-2012-0012433

(51) Int. Cl.
*G09G 3/3258* (2016.01)
*G09G 3/3233* (2016.01)
(Continued)

(52) U.S. Cl.
CPC ..... *G09G 3/3258* (2013.01); *G09G 3/325* (2013.01); *G09G 3/3233* (2013.01);
(Continued)

(58) Field of Classification Search
CPC ..... G09G 3/3258
(Continued)

(56) References Cited

U.S. PATENT DOCUMENTS 9,728,134 B2 * 8/2017 Jeong ..... G09G 3/3233
2003/0103022 A1 6/2003 Noguchi et al.
(Continued)

FOREIGN PATENT DOCUMENTS

CN 101800024 A 8/2010
CN 102063861 A 5/2011
(Continued)

OTHER PUBLICATIONS

Partial European Search Report dated Jul. 2, 2013 for European Patent Application No. EP 12 19 1721.5 which shares priority of Korean Patent Application No. KR 10-2012-0012433 with captioned U.S. Appl. No. 13/610,531.
(Continued)

*Primary Examiner* — Long D Pham
(74) *Attorney, Agent, or Firm* — Lewis Roca Rothgerber Christie LLP

(57) ABSTRACT

A pixel and an organic light emitting diode (OLED) display using the pixel are disclosed. The pixel includes a driving transistor for transmitting a driving current, an OLED configured to receive a first portion of the driving current and a bypass transistor configured to receive a second portion of the driving current.

14 Claims, 13 Drawing Sheets

Related U.S. Application Data continuation of application No. 13/610,531, filed on Sep. 11, 2012, now Pat. No. 9,324,264.

(51) Int. Cl.
*G09G 3/325* (2016.01)
*G09G 3/3266* (2016.01)
*G09G 3/3291* (2016.01)

(52) U.S. Cl.
CPC ..... *G09G 3/3266* (2013.01); *G09G 3/3291* (2013.01); *G09G 2300/0809* (2013.01); *G09G 2300/0814* (2013.01); *G09G 2300/0819* (2013.01); *G09G 2300/0842* (2013.01); *G09G 2300/0861* (2013.01); *G09G 2310/0278* (2013.01); *G09G 2320/0238* (2013.01)

(58) Field of Classification Search
USPC ..... 345/82
See application file for complete search history.

(56) References Cited

U.S. PATENT DOCUMENTS

| | | | | |
|---|---|---|---|---|
| 2005/0259093 | A1 | 11/2005 | Osame et al. | |
| 2006/0022305 | A1 | 2/2006 | Yamashita | |
| 2006/0022907 | A1 | 2/2006 | Uchino et al. | |
| 2009/0273547 | A1 | 11/2009 | Tanikame et al. | |
| 2009/0315870 | A1 | 12/2009 | Goh et al. | |
| 2010/0079361 | A1* | 4/2010 | Lee | G09G 3/3233 345/77 |
| 2010/0091001 | A1 | 4/2010 | Kim et al. | |
| 2012/0001893 | A1* | 1/2012 | Jeong | G09G 3/3233 345/213 |
| 2012/0001896 | A1 | 1/2012 | Han et al. | |

FOREIGN PATENT DOCUMENTS

| | | | |
|---|---|---|---|
| JP | 2003-186437 | A | 7/2003 |
| JP | 2003-208127 | A | 7/2003 |
| JP | 2010-217661 | A | 9/2010 |
| JP | 2010-286526 | A | 12/2010 |
| KR | 10-2007-0102070 | A | 10/2007 |
| KR | 10-2010-0009219 | A | 1/2010 |
| KR | 10-2010-0035847 | | 4/2010 |
| KR | 10-2011-0078787 | A | 7/2011 |
| KR | 10-2011-0080387 | A | 7/2011 |
| WO | WO 2007/111202 | A1 | 10/2007 |

OTHER PUBLICATIONS

Extended European Search Report dated Sep. 27, 2013 for European Patent Application No. EP 12 191 721.5 which shares priority of Korean Patent Application No. KR 10-2012-0012433 with captioned U.S. Appl. No. 13/610,531.

* cited by examiner

PIXEL AND ORGANIC LIGHT EMITTING DIODE DISPLAY HAVING A BYPASS TRANSISTOR FOR PASSING A PORTION OF A DRIVING CURRENT

CROSS-REFERENCE TO RELATED APPLICATION

This application is a continuation of U.S. patent application Ser. No. 15/136,721, filed Apr. 22, 2016, which is a continuation of U.S. patent application Ser. No. 13/610,531, filed Sep. 11, 2012, now U.S. Pat. No. 9,324,264, which claims priority to and the benefit of Korean Patent Application No. 10-2012-0012433, filed Feb. 7, 2012, the entire contents of all of which are incorporated herein by reference.

BACKGROUND

1. Field of the Invention

The disclosed technology relates to a pixel and an organic light emitting diode (OLED) display using the same, and particularly, to a pixel for improving a contrast ratio of a high-resolution organic light emitting diode display and an organic light emitting diode display including the same.

2. Description of the Related Technology

Various flat panel displays that have reduced weight and volume as compared to cathode ray tube technology have been developed. The flat panel display technologies include liquid crystal display (LCD), field emission display (FED), plasma display panel (PDP), organic light emitting diode (OLED) display, and the like.

An organic light emitting diode (OLED) display displays images by using organic light emitting diodes (OLED) that generate light by recombining electrons and holes. An OLED display has a fast response speed, is driven with low power consumption, and has excellent emission efficiency, luminance, and viewing angle, has recently been in the limelight.

A driving method of the organic light emitting diode (OLED) display is generally classified into a passive matrix type and an active matrix type.

The passive matrix type of driving method has alternately arranged anodes and cathodes in the display area in a matrix form, and pixels are formed at intersections of the anodes and the cathodes.

The active matrix type of driving method has a thin film transistor for each pixel and controls each pixel by using the thin film transistor. The active matrix type of driving method has less parasitic capacitance and power consumption compared to the passive matrix type of driving method, but it has a drawback of non-uniform luminance.

Particularly, current density of the thin film transistor for a high resolution structure is increased and material efficiency is increased by developing a material of the organic light emitting diode so a black current for displaying a black image relatively rises. That is, when the black current that is a minimum current for displaying the black image is transmitted, the pixel including the efficiency-improved organic light emitting diode displays an image that is brighter than the black luminance corresponding to the black current. Therefore, the contrast ratio of the entire display image of a panel including the pixel is deteriorated. Accordingly, the pixel or the display device must be studied in order to control a flow of a minimum driving current transmitted to the organic light emitting diode and maintain a high contrast ratio on a display screen.

The above information disclosed in this Background section is only for enhancement of understanding of the background of the invention and therefore it may contain information that does not form the prior art that is already known in this country to a person of ordinary skill in the art.

SUMMARY

One inventive aspect is a pixel including a pixel driver including a driving transistor that transmits a driving current corresponding to a data voltage caused by a data signal transmitted from a corresponding data line according to a scan signal transmitted from a corresponding scan line, an organic light emitting diode (OLED) to which a first portion of the driving current flows, and a bypass transistor to which a second portion of the driving current flows. A light emitting period during which the first portion flows to the organic light emitting diode (OLED) includes an off period during which the bypass transistor is turned off.

Another inventive aspect is an organic light emitting diode display including a scan driver for transmitting a plurality of scan signals to a plurality of scan lines, a data driver for transmitting a plurality of data signals to a plurality of data lines, and a display unit including a plurality of pixels that are connected to corresponding scan lines and corresponding data lines. The display unit is configured to display an image by emitting light according to the data signals. The display also includes a power supply for supplying a first power source voltage, a second power source voltage, and a variable voltage to the pixels, and includes a controller for controlling the scan driver, the data driver, and the power supply, and is configured to generate the data signals and to supply them to the data driver. The pixels respectively include a driving transistor turned on by a scan signal transmitted from the corresponding scan line, and configured to generate a driving current corresponding to a data voltage caused by a data signal transmitted from a corresponding data line. The pixels also include an organic light emitting diode (OLED) to which a first portion of the driving current flows, and a bypass transistor to which a second portion of the driving current flows, where a light emitting period during which the first current flows to the organic light emitting diode (OLED) includes an off period during which the bypass transistor is turned off.

DETAILED DESCRIPTION

Figure 1:
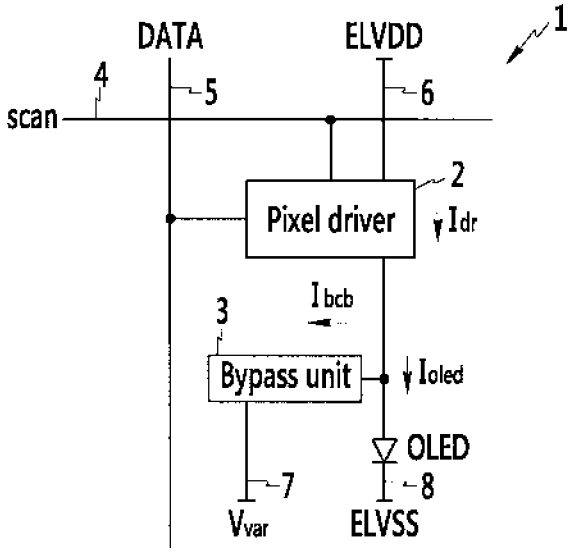
FIG. 1 shows a schematic diagram of a pixel of an organic light emitting diode (OLED) display according to an exemplary embodiment.

Various aspects are described more fully hereinafter with reference to the accompanying drawings, in which exemplary embodiments are shown. As those skilled in the art would realize, the described embodiments may be modified in various different ways, all without departing from the spirit or scope of the present invention.

In addition, in various exemplary embodiments, the same reference numerals are used in respect to the constituent elements having the same constitution and illustrated in the first exemplary embodiment, and in the other exemplary embodiments, only constitutions that are different from the first exemplary embodiment are illustrated.

The drawings and description are to be regarded as illustrative in nature and not restrictive. Like reference numerals generally designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 shows a schematic diagram of a pixel 1 of an organic light emitting diode (OLED) display according to an exemplary embodiment.

Referring to FIG. 1, the pixel 1 is provided at an area where a corresponding scan line 4 crosses a corresponding data line 5.

Also, the pixel 1 includes a pixel driver 2 connected to a supply line 6 of a first power source voltage (ELVDD), an organic light emitting diode (OLED) having a cathode connected to a supply line 8 of a second power source voltage (ELVSS) that is less than a first power source voltage (ELVDD), and a bypass unit 3 connected between an anode of the organic light emitting diode (OLED) and the pixel driver 2. In detail, the bypass unit 3 includes a first end connected to a node of the anode of the organic light emitting diode (OLED) and the pixel driver 2, and a second end connected to a supply line 7 of a variable voltage (Vvar).

The pixel driver 2 includes a plurality of transistors and capacitors.

When turned on in response to a scan signal (SCAN) supplied by a scan line 4, the pixel driver 2 receives a data signal (DATA) from a data line 5. The data signal (DATA) applied to the pixel driver 2 can be stored in a capacitor of the pixel driver 2 as a voltage. The data voltage corresponding to the stored data signal (DATA) is generated to be a predetermined driving current (Idr) and is then transmitted to the organic light emitting diode (OLED), and light is emitted and an image is displayed corresponding to a light emitting current (Ioled) transmitted to the organic light emitting diode (OLED).

In this instance, the pixel driver 2 is connected to the supply line 6 for supplying a predetermined first power source voltage (ELVDD), and the pixel driver 2 receives power for generating a driving current through the supply line 6 of the first power source voltage (ELVDD).

The pixel driver 2 can include two transistors and one capacitor (i.e., 2TR1CAP structure), and various circuits of the pixel driver 2 will be described with reference to subsequent drawings.

When material characteristics of the organic light emitting diode (OLED) are used and material efficiency is improved, the image can be displayed with luminance that is greater than black luminance under a black luminance condition, so the pixel 1 according to the exemplary embodiment includes the bypass unit 3 for bypassing a part of a black current flowing to the organic light emitting diode (OLED). Here, the black current represents a driving current that is applied to the transistor of the pixel 1 and is needed for emitting the organic light emitting diode (OLED) of the pixel with minimum luminance (i.e., black luminance).

Also, the bypassing of a part of the black current prevents undesired high current from being supplied to the organic light emitting diode (OLED) so it prevents deterioration of the material characteristics of the organic light emitting diode.

In detail, as can be known with reference to FIG. 1, the pixel 1 includes the bypass unit 3 that does not transmit all the driving current (Idr) generated by the pixel driver 2 as the light emitting current (Ioled) of the organic light emitting diode (OLED) but branches it into a predetermined bypass current (Ibcb) and controls it to bypass.

The bypass unit 3 is connected to the power supply line 7 for supplying the variable voltage (Vvar) controlled to vary a voltage level according to a predetermined interval of one frame so as to bypass the bypass current (Ibcb).

According to the exemplary embodiment, material efficiency can be increased because of development of materials of the organic light emitting diode (OLED), or luminance of actually displaying black current can be increased because the current density for a high resolution structure is increased. So, the contrast ratio is reduced, and it is impossible to reduce the black current to be less than a threshold of a transistor off level so as to prevent the problem. The bypass unit 3 for bypassing a part of the black current is configured in a like manner of the pixel shown in FIG. 1.

Therefore, the part of the black current passing through the bypass unit 3 and bypassing, that is, a bypass current (Ibcb), has a current value of a transistor off level, so it gives substantial influence to realization of a video signal for displaying the black luminance and it gives very much less influence to realization of a video signal (particularly a white luminance video signal) for displaying high luminance. A supply source of the variable voltage (Vvar) connected to the bypass unit 3 can supply the variable voltage (Vvar) of which the voltage level is controlled so that the bypass current (Ibcb) may bypass and flow particularly during an interval of the black luminance condition in one frame period of the display image.

A detailed configuration of the pixel driver 2 and the bypass unit 3 will be described in various embodiments corresponding to the organic light emitting diode (OLED) display according to the exemplary embodiment.

Figure 2:
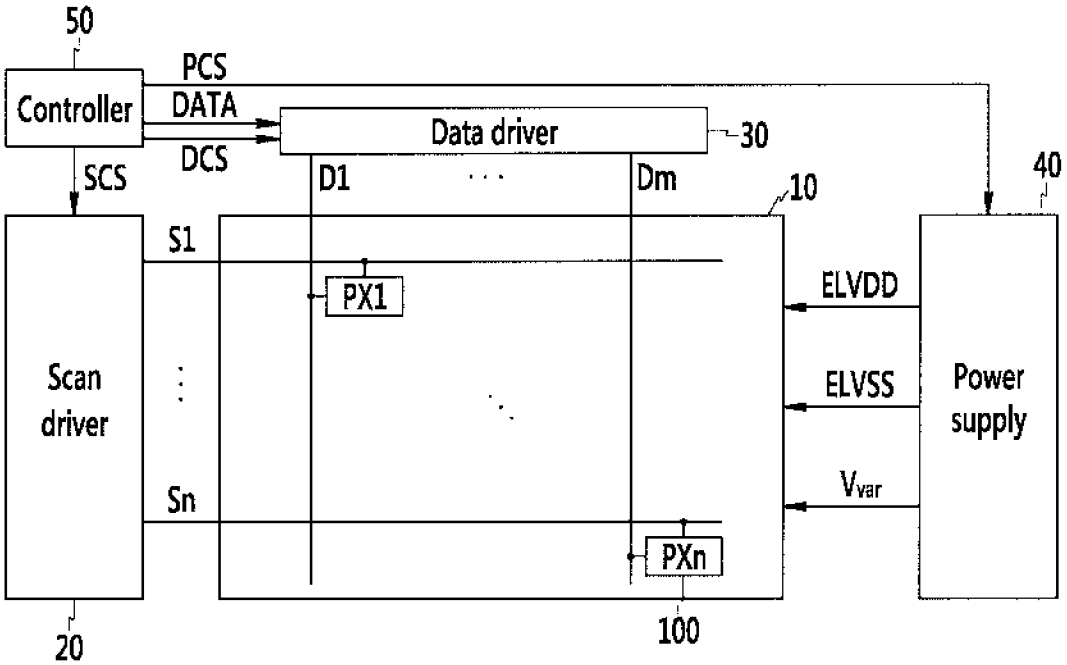
FIG. 2 shows a block diagram of an organic light emitting diode (OLED) display according to an exemplary embodiment.

FIG. 2 shows a block diagram of an organic light emitting diode (OLED) display according to an exemplary embodiment.

Referring to FIG. 2, the organic light emitting diode (OLED) display includes a display unit 10 including a plurality of pixels (PX1 to PXn), a scan driver 20, a data driver 30, a power supply 40, and a controller 50.

The respective pixels (PX1 to PXn) are connected to one of the scan lines (S1 to Sn) connected to the display unit 10 and one of the data lines (D1 to Dm). Although not shown in the display unit 10 of FIG. 2, the respective pixels (PX1 to PXn) are connected to the power supply line connected to the display unit 10 and receive the first power source voltage (ELVDD), the second power source voltage (ELVSS), and the variable voltage (Vvar).

The first power source voltage (ELVDD) and the second power source voltage (ELVSS) have fixed voltage values during a plurality of frames in which an image is displayed, and the variable voltage (Vvar) can have a variable voltage value of which the voltage level is changeable for each predetermined period of one frame.

For example, the first power source voltage (ELVDD) can be a predetermined high level voltage, the second power source voltage (ELVSS) can be either the first power source voltage (ELVDD) or a ground voltage, and the variable voltage (Vvar) can be set to be equal to or less than the second power source voltage (ELVSS) depending on a predetermined period.

The display unit 10 includes a plurality of pixels (PX1 to PXn) substantially arranged in a matrix form. Although not restricted, the scan lines (S1 to Sn) are substantially extended in a row direction in the arranged form of the pixels and they are substantially in parallel with each other, and the data lines (D1 to Dm) are substantially extended in a column direction and they are substantially in parallel with each other.

The respective pixels (PX1 to PXn) emit light with predetermined luminance by a driving current that is supplied to the organic light emitting diode (OLED) according to a data signal transmitted through the data lines (D1 to Dm).

The scan driver 20 generates scan signals corresponding to the respective pixels and transmits them through the scan lines (S1 to Sn). That is, the scan driver 20 transmits the scan signals to the pixels included in the pixel lines through the corresponding scan lines.

The scan driver 20 receives a scan drive control signal (SCS) from the controller 50 to generate the scan signals, and sequentially supplies the scan signals to the scan lines (S1 to Sn) connected to the pixel lines. The pixel drivers of the pixels included in the pixel lines are turned on.

The data driver 30 transmits data signals to the pixels through the data lines (D1 to Dm).

The data driver 30 receives a data drive control signal (DCS) from the controller 50 and supplies data signals corresponding to the data lines (D1 to Dm) connected to the pixels included in the pixel lines.

The controller 50 converts a plurality of video signals transmitted from the outside into a plurality of image data signals (DATA) and transmits them to the data driver 30. The controller 50 receives a vertical synchronization signal (Vsync), a horizontal synchronization signal (Hsync), and a clock signal (MCLK) (not shown), generates control signals for controlling the scan driver 20 and the data driver 30, and transmits the control signals to them. That is, the controller 50 generates a scan drive control signal (SCS) for controlling the scan driver 20 and a data drive control signal (DCS) for controlling the data driver 30, and transmits the same to them. Also, the controller 50 generates a power control signal (PCS) for controlling the power supply 40 and transmits it to the power supply 40.

The power supply 40 supplies the first power source voltage (ELVDD), the second power source voltage (ELVSS), and the variable voltage (Vvar) to the pixel of the display unit 10. The voltage values of the first power source voltage (ELVDD), the second power source voltage (ELVSS), and the variable voltage (Vvar) are not restricted, and they can be set or controlled by controls of the power control signal (PCS) transmitted by the controller 50.

Particularly, the power supply 40 can control the voltage level of the variable voltage (Vvar) so that a part of the black current may flow through a path other than the organic light emitting diode (OLED) at a predetermined pixel by control of the power control signal (PCS). In this instance, the power supply 40 finds an optimized DC voltage according to a panel characteristic, and applies the DC voltage level to the variable voltage (Vvar) supplied per panel.

Figure 3:
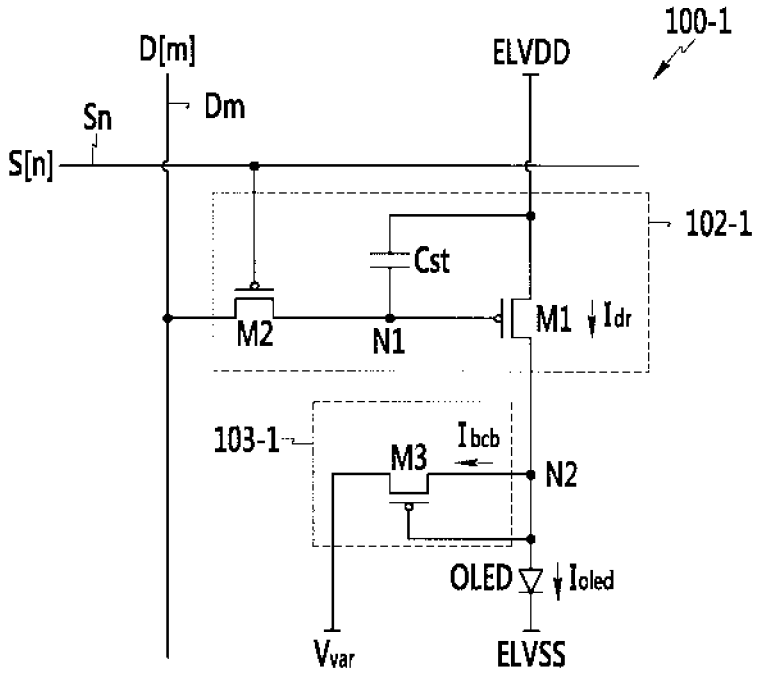
FIG. 3 shows a circuit diagram of a pixel shown in FIG. 2 according to a first exemplary embodiment.
Figure 4:
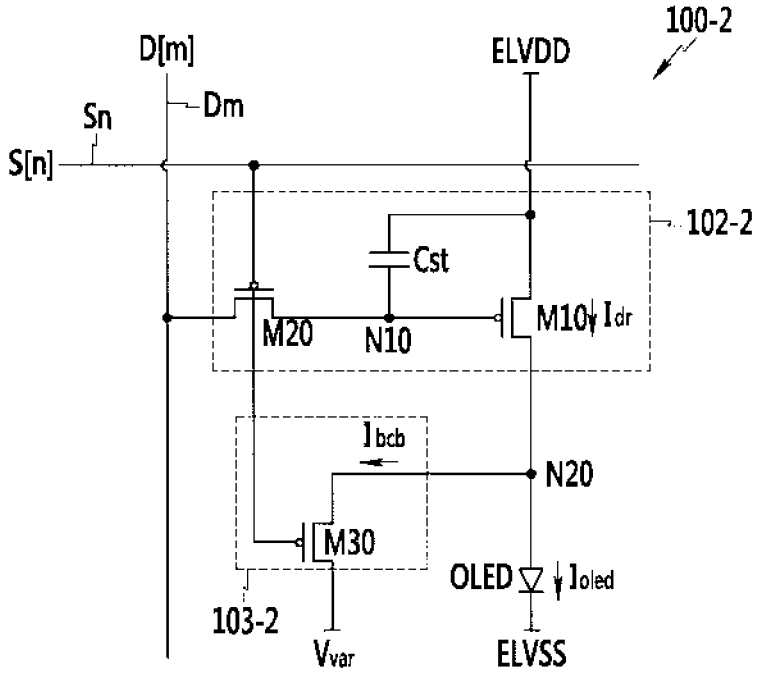
FIG. 4 shows a circuit diagram of a pixel shown in FIG. 2 according to a second exemplary embodiment.
Figure 5:
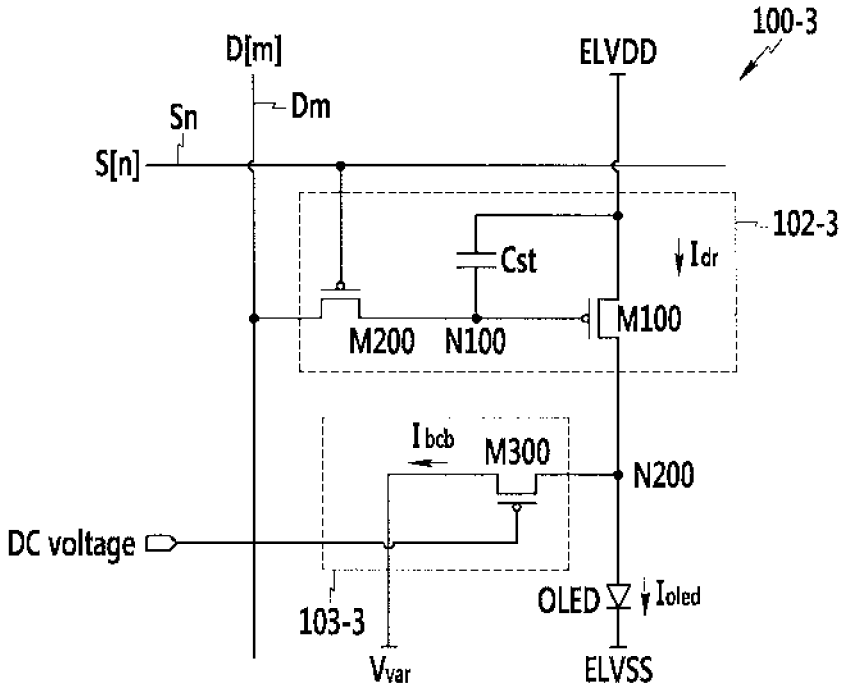
FIG. 5 shows a circuit diagram of a pixel shown in FIG. 2 according to a third exemplary embodiment.

FIG. 3 to FIG. 5 show circuit diagrams of a pixel according to exemplary embodiments. Particularly, FIG. 3 to FIG. 5 show a circuit configuration of a pixel (PXn) 100 provided in an area defined by an n-th pixel row and an m-th pixel column from among a plurality of pixels (PX1 to PXn) of the display unit 10 shown in FIG. 2 according to another exemplary embodiment.

A pixel 100-1 of FIG. 3 includes a pixel driver 102-1 including two transistors M1 and M2 and one capacitor Cst, and a bypass unit 103-1 including one transistor M3. The pixel 100-1 is provided in the area defined by the n-th pixel row and the m-th pixel column from among the pixels of the display, and is connected to the n-th scan line (Sn), the m-th data line Dm, and the power supply line for supplying the first power source voltage (ELVDD), the second power source voltage (ELVSS), and the variable voltage (Vvar).

Regarding a circuit diagram of a pixel to be described with reference to accompanying drawings including FIG. 3, for convenience of description, a PMOS transistor will be exemplified for a transistor, a circuital element, and a corresponding operation will be described. However, the embodiment is not restricted to the configuration of the pixel.

In detail, the pixel driver 102-1 includes a driving transistor M1, a switching transistor M2, and a storage capacitor Cst.

The driving transistor M1 includes a gate electrode connected to a first node N1, a source electrode connected to a supply line of the first power source voltage (ELVDD), and a drain electrode connected to a second node N2.

The switching transistor M2 includes a gate electrode connected to the n-th scan line (Sn), a source electrode connected to the m-th data line Dm, and a drain electrode connected to the first node N1.

The storage capacitor Cst includes a first electrode connected to the first node N1, and a second electrode connected to a contact node where the supply line of the first power source voltage (ELVDD) is connected to the source electrode of the driving transistor M1.

The switching transistor M2 is turned on or turned off in response to the scan signal (S[n]) through the n-th scan line (Sn). When receiving the scan signal (scan[n]) with a voltage level which turns on the switching transistor M2, the switching transistor M2 transmits the data voltage following the data signal (D[m]) corresponding to the first node N1 through the m-th data line Dm connected to the source electrode.

The storage capacitor Cst with the first electrode connected to the first node N1 stores a voltage caused by a voltage difference between both electrodes of the storage capacitor Cst. Therefore, the storage capacitor Cst stores the voltage corresponding to the voltage difference between the data voltage transmitted to the first node N1 and the first power source voltage (ELVDD).

Referring to FIG. 3, both electrodes of the storage capacitor Cst are connected to the gate electrode and the source electrode of the driving transistor M1 so the voltage corresponding to a voltage difference between both ends of the storage capacitor Cst corresponds to a voltage (Vgs) between the gate and the source of the driving transistor M1.

When a data voltage caused by a data signal is applied through the switching transistor M2 that is turned on by the scan signal (S[n]), the driving transistor M1 generates a driving current (Idr) following the voltage (Vgs) between the gate and the source corresponding to the data voltage and transmits it to the organic light emitting diode (OLED).

In this instance, when the black current is transmitted as the driving current (Idr) under the black luminance condition in which the applied data signal is a black video signal, the organic light emitting diode (OLED) emits light with luminance that is greater than expected luminance of the black luminance so that it may deteriorate a contrast ratio in the screen and may worsen image quality. In order to improve this problem, it is needed to reduce the light emitting current (Ioled) applied to the organic light emitting diode (OLED) under the black luminance condition. However, it is impossible to reduce the black current to be less than the limit of an off level voltage of the transistor so the pixel according to the exemplary embodiment further includes a bypass unit 103-1 as shown in FIG. 3 to bypass a part of the black current. That is, the bypass unit 103-1 of FIG. 3 bypasses a part of the black current as the bypass current (Ibcb) so that the driving current (Idr) representing the black current corresponding to the black image data signal may not be transmitted to the organic light emitting diode (OLED). The light emitting current (Ioled) applied to the organic light emitting diode (OLED) is reduced to be less than the black current applied as driving current so the organic light emitting diode (OLED) can emit light with black luminance, thereby improving the contrast ratio.

Referring to FIG. 3, the bypass unit 103-1 includes a bypass transistor M3 including a gate electrode and a source electrode connected to a second node N2 to which the drain electrode of the driving transistor M1 and the anode of the organic light emitting diode (OLED) are connected, and a drain electrode connected to the power supply line of the variable voltage (Vvar).

In this instance, the variable voltage (Vvar) is connected to the drain electrode of the bypass transistor M3 to control the voltage difference (Vds) between the source electrode voltage and the drain electrode voltage of the bypass transistor M3, and thereby control the bypass current (Ibcb).

The gate electrode and the source electrode of the bypass transistor M3 are connected in common to the second node N2 so the voltage difference between the gate and the source is 0V and the bypass transistor M3 is always turned off. The supply line of the variable voltage (Vvar) is connected to the drain electrode of the bypass transistor M3 so while the bypass transistor M3 is turned off, a predetermined bypass current (Ibcb) flows from the black current through the bypass transistor M3 by a predetermined voltage value of the variable voltage (Vvar). In this instance, the predetermined voltage value of the variable voltage (Vvar) is not restricted, and for example, it can be equal to or less than the second power source voltage (ELVSS), the voltage value at the cathode of the organic light emitting diode (OLED). When the bypass transistor M3 is always turned off, the predetermined voltage value of the variable voltage (Vvar) becomes a variable for controlling a current amount of the bypass current (Ibcb).

The bypass unit 103-1 of the pixel according to the exemplary embodiment shown in FIG. 3 can persistently maintain the turned off state because of the structure of the bypass transistor M3 so it can bypass the bypass current when an image driving current caused by the image data signal of general luminance including a maximum driving current for indicating white luminance in addition to the black current is transmitted to the organic light emitting diode (OLED). A bypassing influence of the bypass current is great when the black current is transmitted in the pixel of FIG. 3, and a bypassing influence of the bypass current is small when the driving current for realizing an image with another luminance is transmitted because the size of the corresponding bypass current is very much less. Therefore, the pixel according to the exemplary embodiment shown in FIG. 3 and the display device including the same can improve the contrast ratio since they can express an image in a low luminance stage with an accurate target luminance value without influencing image display quality in a general luminance stage.

FIG. 4 shows a circuit diagram for a circuit configuration of a pixel (PXn) 100 shown in FIG. 2 according to an exemplary embodiment different from FIG. 3.

A pixel driver 102-2 included in a pixel 100-2 according to the exemplary embodiment of FIG. 4 is equivalent to that of FIG. 3 so its configuration and operation will not be described, and a configuration of a bypass unit 103-2 will now be described.

The bypass unit 103-2 of the pixel 100-2 shown in FIG. 4 includes a bypass transistor M30. The bypass transistor M30 includes a gate electrode connected to the n-th scan line (Sn) to which a gate electrode of a switching transistor M20 is connected, a source electrode connected to the node N20 to which the drain electrode of the driving transistor M10 and the anode of the organic light emitting diode (OLED) are connected, and a drain electrode connected to the power supply line of the variable voltage (Vvar).

Differing from FIG. 3, the bypass transistor M30 of FIG. 4 is not always turned off and it can be turned on or off in response to the scan signal (S[n]) that is transmitted to the gate electrode through the n-th scan line (Sn). Therefore, the bypass transistor M30 is turned on during a scan period in which the scan signal (S[n]) is transmitted with a voltage level turning on transistor M30 so as to activate the pixel driver 102-2 during an image drive frame. The bypass current (Ibcb) can bypass and flow to the bypass transistor M30 according to the voltage level of the variable voltage (Vvar). In that case, the current amount of the bypass current (Ibcb) can be increased, and the current amount of the actual light emitting current (Ioled) of the organic light emitting diode (OLED) emitting light with a corresponding luminance image according to the image data signal can be reduced significantly. This gives a substantial bad influence to realization of image quality so in the case of the exemplary embodiment having the pixel configuration of FIG. 4, the variable voltage (Vvar) can be set to be greater than the second power source voltage (ELVSS) that is a cathode voltage of the organic light emitting diode (OLED) so that the bypass current (Ibcb) may not flow.

In the exemplary embodiment shown with reference to the FIG. 4, when the scan signal (S[n]) is transmitted as a high level voltage and the bypass transistor M30 is turned off, the bypass current (Ibcb) can bypass and flow out according to a predetermined voltage value of the variable voltage (Vvar) connected to the drain electrode of the bypass transistor M30. That is, while the driving transistor M10 is not operated and the light emitting current (Ioled) is not supplied to the organic light emitting diode (OLED), light emission caused by transmission of a weak leakage current is prevented, and the bypass current (Ibcb), a fine current, can be bypassed through the turned off bypass transistor M30 so as to prevent deterioration of the organic light emitting diode (OLED). In this instance, the predetermined voltage of the variable voltage (Vvar) can be a predetermined low voltage and is not restricted, and for example, it can be equal to or less than the second power source voltage (ELVSS).

FIG. 5 shows a circuit diagram of a circuit configuration of the pixel (PXn) 100 shown in FIG. 2 according to another exemplary embodiment differing from FIG. 3 and FIG. 4.

A pixel driver 102-3 included in a pixel 100-3 shown with reference to FIG. 5 is equivalent to those shown in FIG. 3 and FIG. 4 so its configuration and operation will not be described and a configuration of a bypass unit 103-3 will now be described.

The bypass unit 103-3 includes a bypass transistor M300 including a source electrode connected to a second node ND200, a drain electrode connected to a variable voltage supply source, and a gate electrode connected to a DC voltage supply source.

The DC voltage supply source supplies a DC voltage with a predetermined level to the gate electrode of the bypass transistor M300 so that the bypass transistor M300 may be always turned off. The bypass transistor M300 of FIG. 5 shows the case of using a PMOS transistor, and in this instance, the DC voltage can be a predetermined high level voltage for always turning off the bypass transistor M300. For example, the voltage applied to the gate electrode of the bypass transistor M300 can be a DC voltage that is equal to or greater than the first power source voltage (ELVDD).

Figure 6:
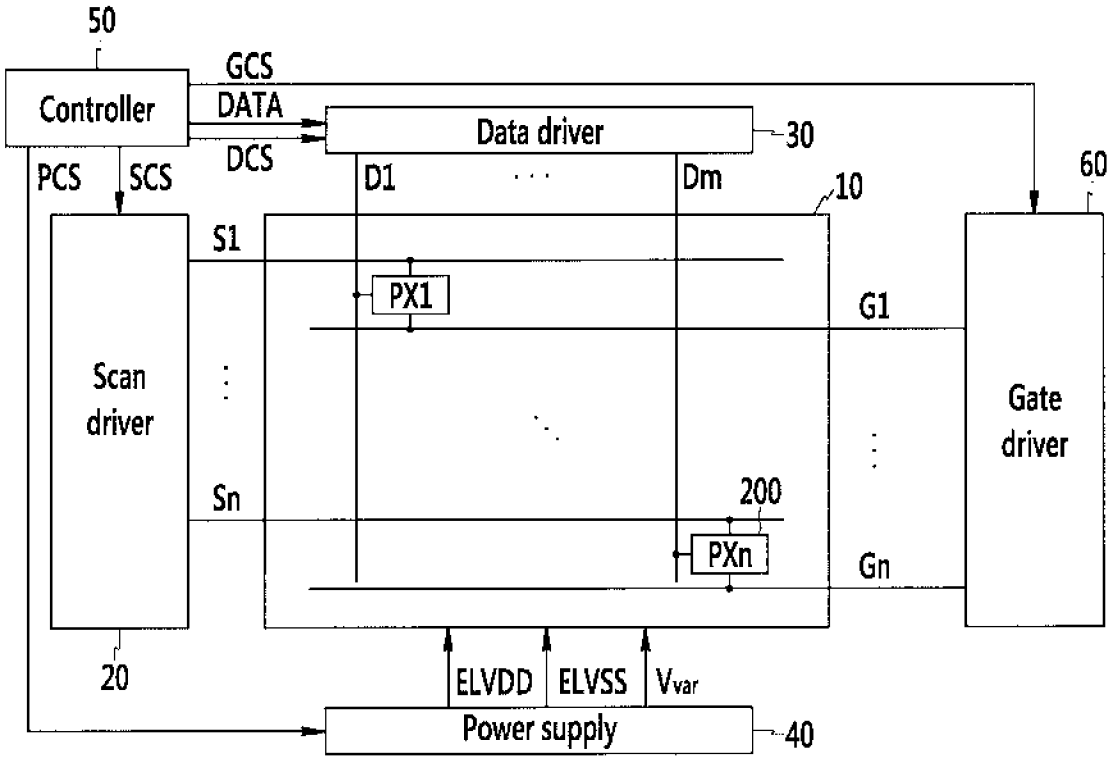
FIG. 6 shows a block diagram of an organic light emitting diode (OLED) display according to another exemplary embodiment.

FIG. 6 shows a block diagram of an organic light emitting diode (OLED) display according to another exemplary embodiment.

The organic light emitting diode (OLED) display shown in FIG. 6 is not different from that shown with reference to FIG. 2 so only additional components will be described.

Differing from the organic light emitting diode (OLED) display of FIG. 2, the organic light emitting diode (OLED) display of FIG. 6 includes a display unit 10 with a plurality of pixels (PX1 to PXn), a scan driver 20, a data driver 30, a power supply 40, a controller 50, and a gate driver 60.

In this instance, the display unit 10 including the pixels (PX1 to PXn) substantially arranged in a matrix form is connected to a plurality of gate lines (G1 to Gn) that are connected to the gate driver 60 and are provided in parallel with each other facing the pixels in a substantially row direction.

The gate driver 60 generates gate signals and transmits them to the corresponding pixels through a plurality of gate lines (G1 to Gn). The gate driver 60 transmits gate signals to respective pixels included in pixel lines through corresponding gate lines (G1 to Gn). In this instance, the gate signals transmitted to the pixels through the gate lines (G1 to Gn) are applied to maintain the bypass transistors included in the respective pixels in a turned off state, so they can be simultaneously transmitted with a voltage level for turning off the transistor for one frame period.

Therefore, by control of the gate signals, the operational states of the bypass transistors of the pixels are maintained in the turned off state, and the bypass current can bypass and flow through the bypass transistor. In this instance, the variable voltage (Vvar) supply source connected to the drain electrode of the bypass transistor can set the variable voltage (Vvar) to be a low voltage to bypass the bypass current.

In the exemplary embodiment shown with reference to FIG. 6, the variable voltage (Vvar) supply source will be the power supply 40 which supplies the first power source voltage (ELVDD), the second power source voltage (ELVSS), and the variable voltage (Vvar) to the respective pixels of the display unit 10. Particularly, the power supply 40 can set the voltage value of the variable voltage (Vvar) to be a low voltage by control of a power control signal (PCS) provided by the controller 50. For example, the voltage value of the variable voltage (Vvar) can be equal to or less than the second power source voltage (ELVSS).

Also, the gate driver 60 receives a gate drive control signal (GCS) from the controller 50 to generate the gate signals, and supplies the gate signals to the gate lines (G1 to Gn) connected to the pixel lines to control the bypass transistors of the pixels included in the pixel line to be maintained in the turned off state.

Figure 7:
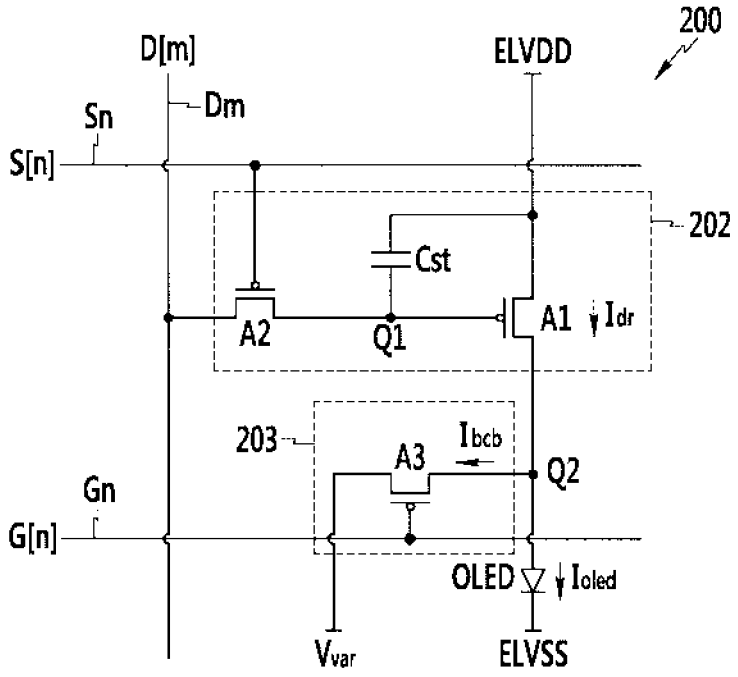
FIG. 7 shows a circuit diagram of a pixel shown in FIG. 6 according to a first exemplary embodiment.

FIG. 7 shows a circuit diagram of a pixel 200 shown in FIG. 6 according to a first exemplary embodiment.

The pixel 200 shown in FIG. 7 includes three transistors and one capacitor in a like manner of the pixel according to the exemplary embodiment of FIG. 3 to FIG. 5.

A pixel driver 202 including the driving transistor A1, the switching transistor A2, and the storage capacitor Cst is equivalent to that shown with reference to FIG. 3 to FIG. 5 so its configuration and operation will not be described and a bypass unit 203 will be described.

The bypass unit 203 of the pixel 200 of FIG. 7 includes a bypass transistor A3. The bypass transistor A3 includes a gate electrode connected to the n-th gate line (Gn), a source electrode connected to a node Q2 of the drain electrode of the driving transistor A1 and the anode of the organic light emitting diode (OLED), and a drain electrode connected to the power supply line of the variable voltage (Vvar).

As described with reference to FIG. 4, the gate signal (G[n]) applied to the gate electrode of the bypass transistor A3 through the n-th gate line (Gn) can be transmitted as a high level voltage that is an off voltage level of the transistor for one frame period to thus turn off the bypass transistor A3 during one frame period. The variable voltage (Vvar) applied to the drain electrode of the bypass transistor A3 can be set to be less than the second power source voltage (ELVSS) connected to the cathode of the organic light emitting diode (OLED) so the bypass current (Ibcb) can bypass and flow to the variable voltage supply source from the node Q2 through the bypass transistor A3.

Figure 8:
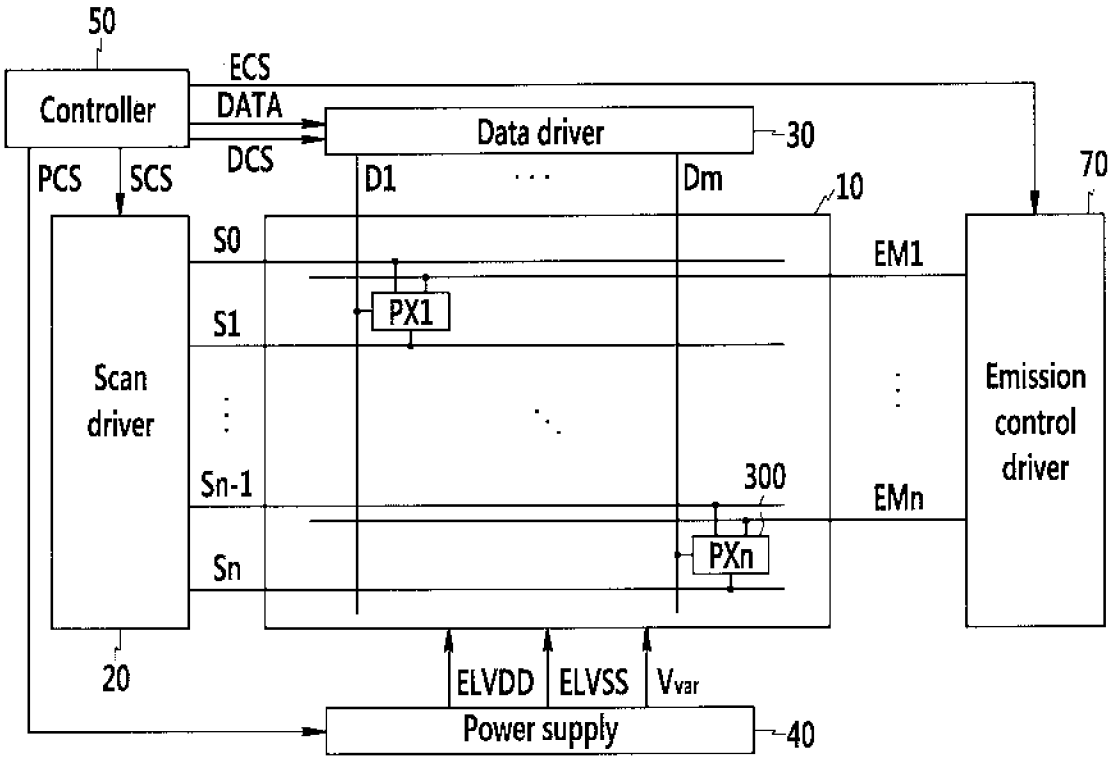
FIG. 8 shows a block diagram of an organic light emitting diode (OLED) display according to the other exemplary embodiment.

FIG. 8 shows a block diagram of an organic light emitting diode (OLED) display according to the other exemplary embodiment.

The organic light emitting diode (OLED) display of FIG. 8 is not much different from the organic light emitting diode (OLED) display according to the exemplary embodiment shown in FIG. 2, so only additional components will be described.

Particularly, the organic light emitting diode (OLED) display includes a display unit 10 having a plurality of pixels (PX1 to PXn), a scan driver 20, a data driver 30, a power supply 40, and a controller 50, and further includes an emission control driver 70 differing from the organic light emitting diode (OLED) display shown in FIG. 2.

The emission control driver 70 is connected to a plurality of emission control lines (EM1 to EMn) connected to the display unit 10 including a plurality of pixels (PX1 to PXn) arranged in a matrix form. That is, the emission control lines (EM1 to EMn) that are extended substantially parallel with each other facing a substantially row direction connect the pixels and the emission control driver 70.

The emission control driver 70 generates light emission control signals and transmits them to the respective pixels through the emission control lines (EM1 to EMn). Having received the light emission control signals, the pixels are controlled to emit an image according to the image data signal in response to control by the light emission control signal. That is, the light emission control transistor included in each pixel is controlled in response to the light emission control signal transmitted through the corresponding emission control line so the organic light emitting diode (OLED) connected to the light emission control transistor may or may not emit light with luminance following the driving current corresponding to the data signal.

The controller 50 of FIG. 8 transmits an emission drive control signal (ECS) for controlling the emission control driver to the emission control driver 70. The emission control driver 70 receives the emission drive control signal (ECS) from the controller 50 and generates the light emission control signals.

Referring to FIG. 8, the pixels (PX1 to PXn) of the display unit 10 are connected to two corresponding scan lines. That is, the pixels (PX1 to PXn) are connected to the scan line corresponding to a pixel row including the corresponding pixel and the scan line corresponding to a pixel row that is prior to the pixel row. The pixels included in the first pixel row can be connected to the first scan line S1 and a dummy scan line S0. The pixels included in the n-th pixel row are connected to the n-th scan line (Sn) corresponding to the n-th pixel row that is the corresponding pixel row and the (n−1)-th scan line Sn−1 corresponding to the (n−1)-th pixel row that is the previous pixel row.

The organic light emitting diode (OLED) display shown in FIG. 8 receives the scan signal corresponding to the pixel row and the scan signal corresponding to the previous pixel row through the two scan lines connected to the pixels and controls the pixel to bypass a part of the light emitting current transmitted to the organic light emitting diode (OLED).

FIG. 9 to FIG. 12 show an example of a circuit diagram of a plurality of pixels (PX1 to PXn) included in the organic light emitting diode (OLED) display shown in FIG. 8, showing the pixel that can be included in the organic light emitting diode (OLED) display shown in FIG. 8. Also, FIG. 13 shows a signal timing diagram for driving a pixel of FIG. 9 to FIG. 12, and an operation process of the pixel circuit diagram according to an exemplary embodiment shown with reference to FIG. 9 to FIG. 12 will now be described.

FIG. 9 to FIG. 12 show a circuit of a pixel (PXn) 300 installed in an area defined by an n-th pixel row and an m-th pixel column from among a plurality of pixels (PX1 to PXn) of the display unit 10 shown in FIG. 8 according to another exemplary embodiment. Further, the pixel shown in FIG. 9 to FIG. 12 includes a pixel driver having six first transistors and two second transistors, and a bypass unit having a transistor. For better understanding and ease of description, the transistors will be assumed to be PMOS transistors.

Figure 9:
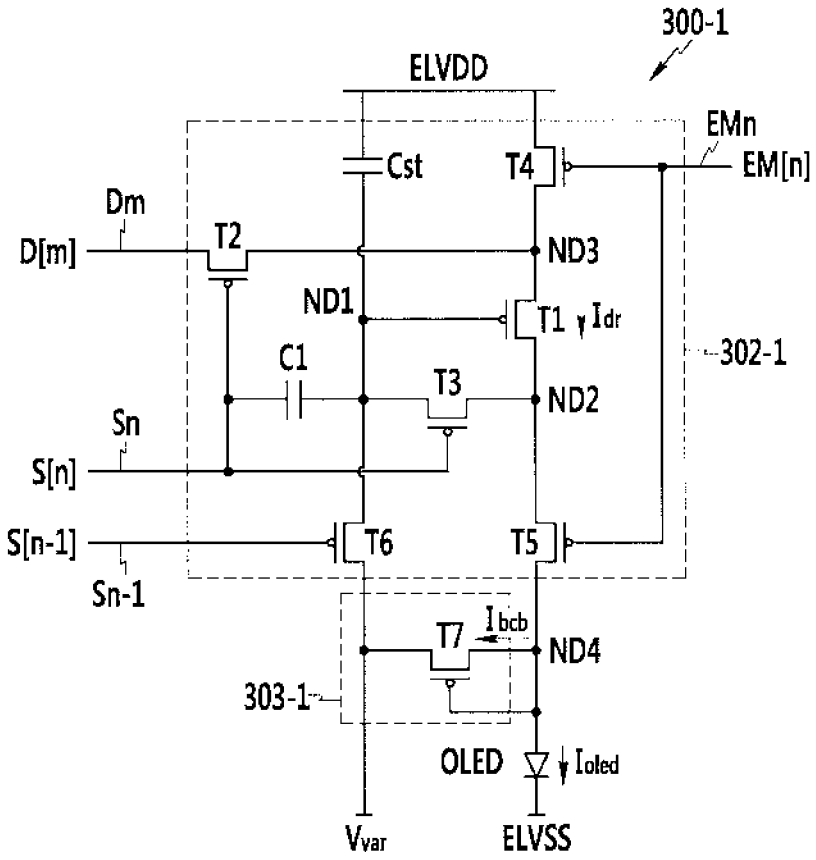
FIG. 9 shows a circuit diagram of a pixel shown in FIG. 8 according to a first exemplary embodiment.

In FIG. 9, the pixel 300-1 includes a pixel driver 302-1, an organic light emitting diode (OLED), and a bypass unit 303-1 connected therebetween.

The pixel driver 302-1 includes a driving transistor T1, a switching transistor T2, a threshold voltage compensation transistor T3, light emission control transistors T4 and T5, a reset transistor T6, a storage capacitor Cst, and a first capacitor C1. Also, the bypass unit 303-1 includes a bypass transistor T7.

The driving transistor T1 includes a gate electrode connected to a first node ND1, a source electrode connected to a third node ND3 connected to a drain electrode of the first light emission control transistor T4, and a drain electrode connected to a second node ND2. The driving transistor T1 generates a driving current (Idr) of a data voltage caused by a corresponding data signal (D[m]) applied to the third node ND3 to which the source electrode of the driving transistor is connected through the m-th data line Dm and the switching transistor T2, and transmits it to the organic light emitting diode (OLED) through the drain electrode. The driving current (Idr) represents a current that corresponds to a voltage difference between the source electrode of the driving transistor T1 and the gate electrode thereof, and the driving current (Idr) becomes different corresponding to the data voltage following the data signal applied to the source electrode.

The switching transistor T2 includes a gate electrode connected to the n-th scan line (Sn), a source electrode connected to the m-th data line Dm, and a drain electrode connected to the third node ND3 to which the source electrode of the driving transistor T1 and the drain electrode of the first light emission control transistor T4 are connected in common. The switching transistor T2 activates driving of the pixel in response to the scan signal (S[n]) transmitted through the n-th scan line (Sn). That is, the switching transistor T2 transmits the data voltage caused by the data signal (D[m]) transmitted through the m-th data line Dm to the third node ND3 in response to the scan signal (S[n]).

The threshold voltage transistor T3 includes a gate electrode connected to the n-th scan line (Sn), and two electrodes respectively connected to the gate electrode and the drain electrode of the driving transistor T1. The threshold voltage transistor T3 is operated in response to the scan signal (S[n]) transmitted through the n-th scan line (Sn), and a threshold voltage of the driving transistor is compensated by connecting the gate electrode and the drain electrode of the driving transistor T1 and thereby diode-connecting the driving transistor T1.

That is, when the driving transistor T1 is diode-connected, the voltage (Vdata−Vth) that is reduced from the data voltage applied to the source electrode of the driving transistor T1 by a threshold voltage of the driving transistor T1 is applied to the gate electrode of the driving transistor T1. The gate electrode of the driving transistor T1 is connected to a first electrode of the storage capacitor Cst so the voltage (Vdata−Vth) is maintained by the storage capacitor Cst. The voltage (Vdata−Vth) to which the threshold voltage (Vth) of the driving transistor T1 is applied is applied to the gate electrode and is then maintained, and the driving current (Idr) flowing to the driving transistor T1 is not influenced by the threshold voltage of the driving transistor T1.

The first light emission control transistor T4 includes a gate electrode connected to the n-th emission control line (EMn), a source electrode connected to the supply line of the first power source voltage (ELVDD), and a drain electrode connected to the third node ND3.

The second light emission control transistor T5 includes a gate electrode connected to the n-th emission control line (EMn), a source electrode connected to the second node ND2, and a drain electrode connected to the fourth node ND4 connected to the anode of the organic light emitting diode (OLED).

The first light emission control transistor T4 and the second light emission control transistor T5 are operated in response to the n-th light emission control signal (EM[n]) transmitted through the n-th emission control line (EMn). That is, when turned on in response to the n-th light emission control signal (EM[n]), the first light emission control transistor T4 and the second light emission control transistor T5 form a current path for allowing the driving current (Idr) to flow toward the organic light emitting diode (OLED) from the first power source voltage (ELVDD) so that the organic light emitting diode (OLED) may emit light according to the light emitting current (Ioled) corresponding to the driving current (Idr) and may display the image of the data signal.

The reset transistor T6 includes a gate electrode connected to the (n−1)-th scan line Sn−1, a source electrode connected to the variable voltage (Vvar) supply line, and a drain electrode connected to the first node ND1 to which the gate electrode of the driving transistor T1 and a first electrode of the threshold voltage compensation transistor T3 are connected in common. The reset transistor T6 transmits the variable voltage (Vvar) that is applied through the variable voltage (Vvar) supply line in response to the (n−1)-th scan signal (S[n−1]) transmitted through the (n−1)-th scan line Sn−1 to the first node ND1. The reset transistor T6 responds to the (n−1)-th scan signal (S[n−1]) preemptively transmitted to the (n−1)-th scan line that corresponds to a previous pixel row of the n-th pixel row including the pixel 300-1 to set the variable voltage (Vvar) as a reset voltage and transmit the same to the first node ND1 before the pixel driver 302-1 is turned on. In this instance, the voltage value of the variable voltage (Vvar) is not restricted and it can be set to have a low-level voltage value so that the gate electrode voltage of the driving transistor T1 is fully reduced to be reset. That is, the gate electrode of the driving transistor T1 is reset with the reset voltage while the (n−1)-th scan signal (S[n−1]) is transmitted to the gate electrode of the reset transistor T6 turning it on.

The storage capacitor Cst includes a first electrode connected to the first node ND1 and a second electrode connected to a supply line of the first power source voltage (ELVDD). As described, since it is connected between the gate electrode of the driving transistor T1 and the supply line of the first power source voltage (ELVDD), the storage capacitor Cst can maintain the voltage applied to the gate electrode of the driving transistor T1.

The first capacitor C1 includes a first electrode connected to the first node ND1 and a second electrode connected to the gate electrode of the switching transistor T2. The first capacitor C1 stores a voltage that corresponds to a difference between the variable voltage (Vvar) applied as a reset voltage to the first electrode and the gate electrode voltage of the switching transistor T2 connected to the second electrode.

Also, the bypass transistor T7 includes a gate electrode and a source electrode connected to the fourth node ND4 to which the drain electrode of the second light emission control transistor T5 and the anode of the organic light emitting diode (OLED) are connected, and a drain electrode connected to the power supply line of the variable voltage (Vvar). Referring to FIG. 8, the gate electrode and the source electrode of the bypass transistor T7 are connected in common to the fourth node ND4 so the voltage difference between the gate and the source is 0V and the bypass transistor T7 is always turned off. The variable voltage (Vvar) supply line is connected to the drain electrode of the bypass transistor T7, so the bypass current (Ibcb) flows through the bypass transistor T7 by the predetermined voltage value of the variable voltage (Vvar) while the bypass transistor T7 is turned off. In this instance, the predetermined voltage value of the variable voltage (Vvar) is not restricted, and for example, it can be equal to or less than the second power source voltage (ELVSS), that is, the cathode voltage value of the organic light emitting diode (OLED). When the minimum current of the transistor for displaying a black image flows as a driving current and the organic light emitting diode (OLED) emits light, the accurate black image is not displayed and the minimum current of the transistor can be divided as a bypass current (Ibcb) to a current path different from the current path to the organic light emitting diode (OLED). In this instance, the minimum current of the transistor represents a current in the case in which the gate-source voltage (Vgs) of the transistor is less than the threshold voltage (Vth) and the transistor is turned off. The minimum driving current (e.g., a current that is less than 10 pA) in the condition in which the transistor is turned off is transmitted to the organic light emitting diode (OLED) and is then displayed as an image with black luminance.

When the minimum driving current for displaying the black image flows, the influence caused by bypassing the bypass current (Ibcb) is great, and when a large driving current for displaying a general image or a white image flows, there is little influence of the bypass current (Ibcb). Therefore, when the driving current for displaying the black image flows, the light emitting current (Ioled) of the organic light emitting diode (OLED) reduced by the current amount of the bypass current (Ibcb) having passed through the path of the bypass unit from the driving current (Idr) has the minimum current amount so that it may accurately express the black image.

A drive operation based on a timing diagram shown in FIG. 13 will be described with reference to a circuit diagram of the pixel 300-1 shown in FIG. 9 to clarify a drive process in which the pixel temporally emits light to display the image.

At a time t1, a scan signal (S[n−1]) transmitted through the (n−1)-th scan line is changed to a low level, and at a period from the time t1 to a time t2, it maintains the low level. In this instance, the scan signal (S[n]) transmitted through the n-th scan line is maintained at a high level. Also, the light emission control signal (EM[n]) transmitted through the n-th emission control line is maintained at the high level voltage.

Therefore, at the pixel 300-1 shown in FIG. 9, the reset transistor T6 for receiving the scan signal (S[n−1]) is turned on. The switching transistor T2 and the threshold voltage compensation transistor T3 to which the scan signal (S[n]) is transmitted are turned off, and the first light emission control transistor T4 and the second light emission control transistor T5 to which the light emission control signal (EM[n]) is transmitted are turned off. The gate and the source of the bypass transistor T7 are connected to the same node, and there is no voltage difference between the gate and the source so the bypass transistor T7 is always turned off.

During the period from the time t1 to the time t2, the variable voltage (Vvar) as a reset voltage is applied through the reset transistor T6 to the first node ND1 to which the gate electrode of the driving transistor T1 is connected. In this instance, the variable voltage (Vvar) can be set such that it may reset the gate electrode voltage of the driving transistor T1.

During the period from the time t1 to the time t2, the first electrode of the storage capacitor Cst is connected to the first node ND1, the variable voltage (Vvar) is applied as a reset voltage to the first electrode, and the high-level first power source voltage (ELVDD) is applied to the second electrode of the storage capacitor Cst so the voltage value corresponding to ELVDD-Vvar is stored therein.

At the time t2, the scan signal (S[n−1]) is changed to the high level, at a time t3, the scan signal (S[n]) transmitted through the n-th scan line is changed to the low level, and during the time t3 to t4, it maintains the low level. At this time, the light emission control signal (EM[n]) is maintained at the high level voltage.

During the time t3 to time t4, the reset transistor T6 is turned off and the switching transistor T2 and the threshold voltage compensation transistor T3 for receiving the scan signal (S[n]) are turned on. The data voltage (Vdata) caused by the data signal (D[m]) is transmitted to the source electrode of the driving transistor T1 through the switching transistor T2, and the driving transistor T1 is diode-connected by the threshold voltage compensation transistor T3. The voltage maintained at the first node ND1 connected to the first electrode of the storage capacitor Cst represents a voltage (Vgs) that corresponds to the voltage difference between the gate electrode and the source electrode of the driving transistor T1, and it represents the voltage value (Vdata−Vth) that is reduced from the data voltage (Vdata) by the threshold voltage (Vth) of the driving transistor T1. The storage capacitor Cst stores and maintains the voltage that corresponds to the voltage difference at both electrodes.

At the time t4, when the scan signal (S[n]) is changed to the high level, the switching transistor T2 and the threshold voltage compensation transistor T3 are turned off and the voltage at the first node ND1 floats.

At a time t5, the light emission control signal (EM[n]) transmitted through the n-th emission control line is changed to the low level.

The first light emission control transistor T4 and the second light emission control transistor T5 of the pixel 300-1 to which the light emission control signal (EM[n]) is transmitted is turned on, and the driving current (Idr) of the data voltage caused by the data signal stored in the storage capacitor Cst during a scan and data writing period at the time t3 to the time t4 is transmitted to the organic light emitting diode (OLED), and then the organic light emitting diode (OLED) emits light.

In detail, the corresponding voltage for calculating the driving current (Idr) becomes ELVDD−Vdata from which the influence of the threshold voltage (Vth) of the driving transistor T1 is eliminated.

When the driving current (Idr) is transmitted as a minimum current for displaying the black luminance image, a fine and small amount of the bypass current (Ibcb) can bypass and flow through the bypass transistor T7 that is always turned off so as to display the accurate black luminance image. Accordingly, the current (Idr−Ibcb) generated by subtracting the bypass current (Ibcb) from the driving current (Idr) represents the light emitting current (Ioled) and can be output as the light with black luminance from the organic light emitting diode (OLED). A process for a predetermined current to bypass the path through the bypass transistor T7 is the same for the black luminance image as well as other image signals that are displayed with various kinds of luminance, and the driving current (Idr) for displaying images with various sorts of luminance including white luminance has a large current amount so the influence of the bypass current (Ibcb) is not substantial in a like manner of the black luminance image.

Figure 10:
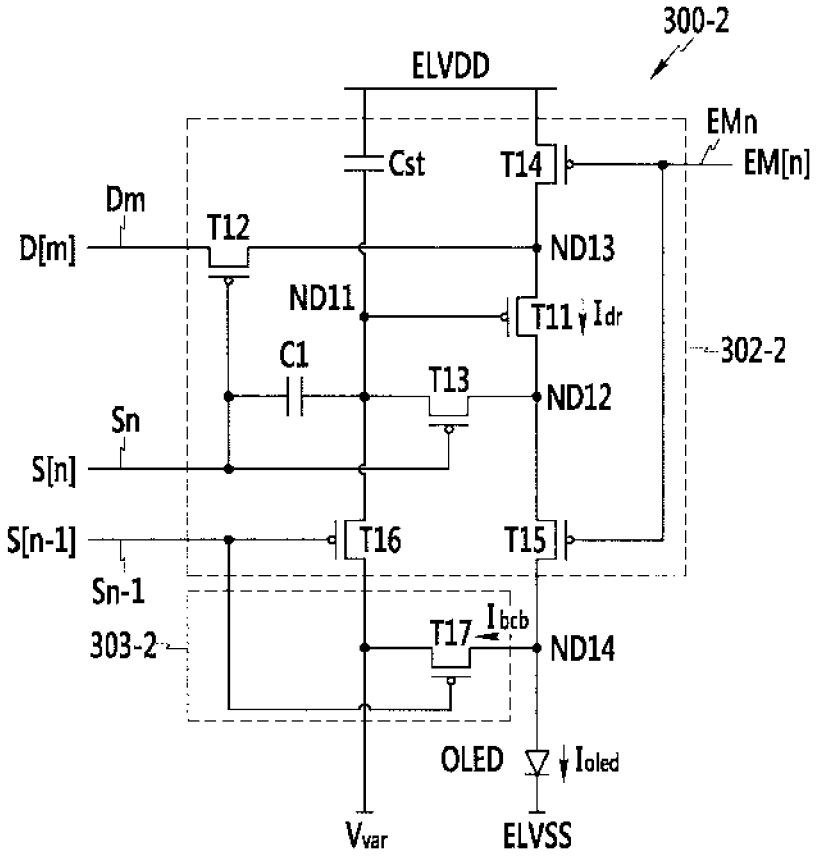
FIG. 10 shows a circuit diagram of a pixel shown in FIG. 8 according to a second exemplary embodiment.

A configuration of the pixel 300-2 shown in FIG. 10 that can be included in the organic light emitting diode (OLED) display of FIG. 8 is not much different from the exemplary embodiment shown in FIG. 9.

The pixel 300-2 shown in FIG. 10 includes a pixel driver 302-2 and an organic light emitting diode (OLED) having the same circuit components and configuration as the pixel driver shown in FIG. 9, and a connection of the bypass transistor T17 of the bypass unit 303-2 is different from that of the bypass unit shown in FIG. 9.

That is, the gate electrode of the bypass transistor T17 is connected to the (n−1)-th scan line Sn−1 together with the gate electrode of the reset transistor T16.

The source electrode of the bypass transistor T17 is connected to the fourth node ND14 to which the drain electrode of the second light emission control transistor T15 and the anode of the organic light emitting diode (OLED) are connected. The drain electrode of the bypass transistor T17 is connected to the power supply line of the variable voltage (Vvar).

Regarding an operational process of the pixel shown in FIG. 10 with reference to FIG. 13, the bypass transistor T17 and the reset transistor T16 are turned on by the low level voltage of the (n−1)-th scan signal (S[n−1]) transmitted through the (n−1)-th scan line Sn−1 during the reset period from the time t1 to the time t2. Therefore, the variable voltage (Vvar) that is controlled to have a voltage level for resetting the gate electrode voltage of the driving transistor T11 is transmitted to the first node ND11 through the reset transistor T16.

During a remaining period except the period from the time t1 to the time t2, the (n−1)-th scan signal (S[n−1]) is changed to the high level voltage and is maintained at the high level so the bypass transistor T17 is turned off. While the corresponding pixel 300-2 is turned on to receive the voltage caused by the data signal and emit light, the bypass current (Ibcb) having a fine current amount bypasses and flows through the turned off bypass transistor T17 to thus realize the definite black luminance when the pixel displays a black image.

Figure 11:
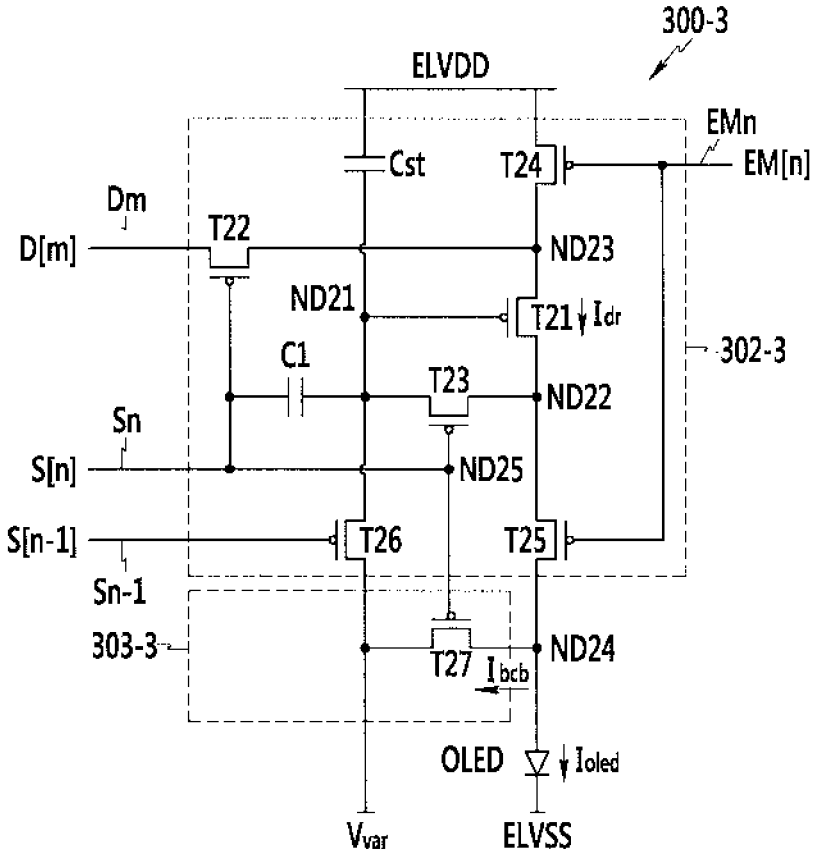
FIG. 11 shows a circuit diagram of a pixel shown in FIG. 8 according to a third exemplary embodiment.

The pixel 300-3 according to the exemplary embodiment shown in FIG. 11 has the same configuration as the pixel 300-2 of FIG. 10, and the difference is that the gate electrode of the bypass transistor T27 is connected to the n-th scan line (Sn).

A drive process of the pixel 300-3 shown in FIG. 11 described with reference to FIG. 13 is not much different from the drive of the pixel shown in FIG. 10, and the bypass transistor T27 is turned on/off in response to the scan signal (S[n]) transmitted through the n-th scan line (Sn). Therefore, during the period from the time t3 to the time t4 after the driving transistor T21 is reset, the bypass transistor T27 and the switching transistor T22 are turned on when the scan signal (S[n]) is transmitted as a low level voltage.

According to the exemplary embodiment shown in FIG. 11, during the same period, the data voltage caused by the data signal is transmitted to the source electrode of the driving transistor T21 through the switching transistor T22, and the driving transistor T21 generates the driving current (Idr) and transmits it to the organic light emitting diode (OLED). In this instance, when the bypass current (Ibcb) flows to a detour through the turned on bypass transistor T27, a loss of the light emitting current (Ioled) is increased and the image quality is substantially deteriorated. Therefore, during the period from the time t3 to the time t4, the variable voltage (Vvar) connected to the drain electrode of the bypass transistor T27 may be set to be greater than a predetermined voltage level so that the bypass current (Ibcb) does not flow. For example, the variable voltage (Vvar) may be set to be greater than the second power source voltage (ELVSS) to which the cathode of the organic light emitting diode (OLED) is connected so that the bypass current (Ibcb) does not go to the variable voltage (Vvar) supply source.

Further, during a period other than the period from the time t3 to the time t4, the scan signal (S[n]) transmitted to the gate electrode of the bypass transistor T27 is transmitted as a high level voltage so the bypass transistor T27 is turned off. During a predetermined period after the time t5 from among the period in which the bypass transistor T27 is turned off, the light emission control signal (EM[n]) is transmitted as low level, and a transfer path of the driving current (Idr) is formed from the driving transistor T21 to the organic light emitting diode (OLED). The bypass current (Ibcb) in the driving current (Idr) can bypass and flow to the variable voltage (Vvar) supply source in correspondence to the voltage difference (Vds) between the variable voltage (Vvar) connected to the drain electrode of the bypass transistor T27 and the source electrode voltage.

When the driving current (Idr) corresponds to the current value for displaying the black luminance image, a fine current amount of the bypass current (Ibcb) bypasses and goes out so the luminance of the light directly emitted by the organic light emitting diode (OLED) corresponds to the light emitting current (Ioled) having the current value of Idr−Ibcb. Hence, the organic light emitting diode (OLED) having a high-efficiency organic light emitting material can definitely realize the black luminance image according to the light emitting current (Ioled).

Figure 12:
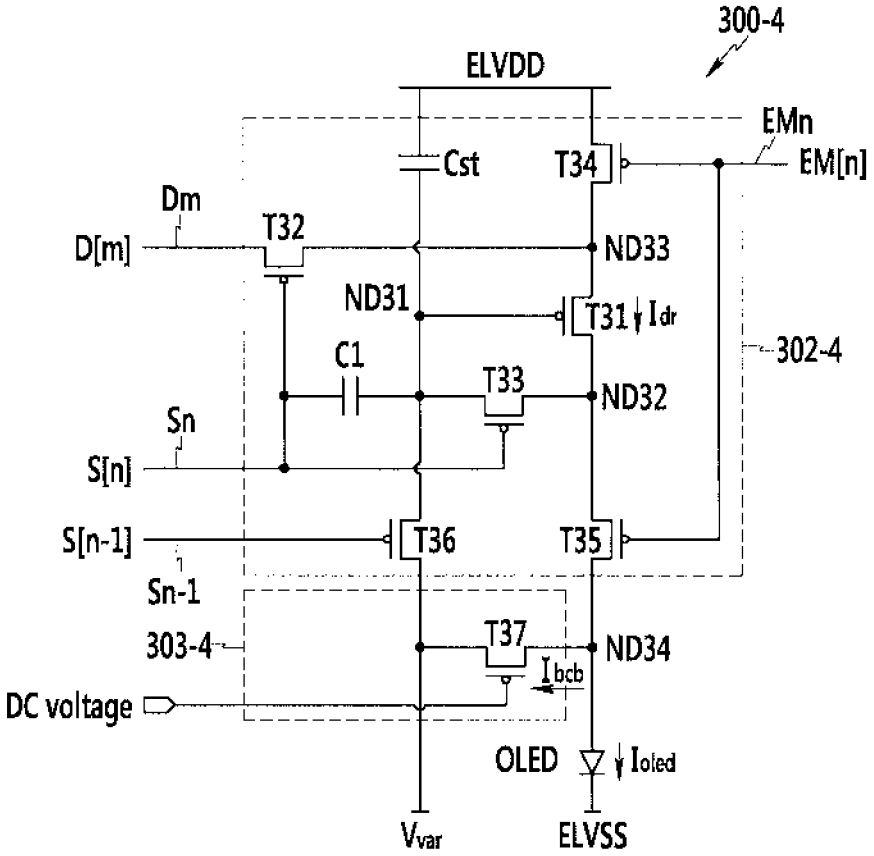
FIG. 12 shows a circuit diagram of a pixel shown in FIG. 8 according to a fourth exemplary embodiment.
Figure 13:
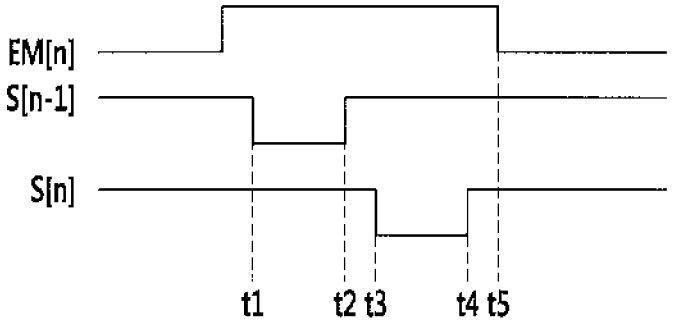
FIG. 13 shows a signal timing diagram of driving of a pixel shown in FIG. 9 to FIG. 12.

The pixel 300-4 according to the exemplary embodiment of FIG. 12 has the same configuration as the pixel 300-3 of FIG. 11 except the difference that the gate electrode of the bypass transistor T37 is connected to the DC voltage supply source.

That is, the bypass unit 303-4 shown in FIG. 12 includes a bypass transistor T37 including a source electrode connected to the fourth node ND34, a drain electrode connected to the variable voltage supply source, and a gate electrode connected to the DC voltage supply source. Therefore, the bypass unit 303-4 receives a predetermined DC voltage from the DC voltage supply source irrespective of elements of the pixel following the drive timing diagram shown in FIG. 13. In this instance, the DC voltage represents a voltage with a predetermined level for turning off the bypass transistor T37, and the DC voltage can be a predetermined high level voltage since the pixel is configured with a PMOS transistor in the exemplary embodiment shown in FIG. 12.

Therefore, the bypass unit 303-4 receives the DC voltage with a transistor off level from the gate electrode, so the bypass transistor T37 is always turned off and allows the bypass current (Ibcb) from the driving current (Idr) to go out through the detour.

The organic light emitting diode (OLED) display including the pixels (300-1, 300-2, 300-3, and 300-4) according to the exemplary embodiment shown in FIG. 9 to FIG. 12 has an excellent image quality characteristic with the improved contrast ratio because of the bypass unit for controlling to realize the accurate black luminance image.

While various aspects have been described in connection with what is presently considered to be practical exemplary embodiments, it is to be understood that the invention is not limited to the disclosed embodiments, but, on the contrary, is intended to cover various modifications and equivalent arrangements. Further, the materials of the components described in the specification may be selectively substituted by various known materials by those skilled in the art. In addition, some of the components described in the specification may be omitted without deterioration of the performance or added in order to improve the performance by those skilled in the art. Moreover, the sequence of the steps of the method described in the specification may be changed depending on a process environment or equipments by those skilled in the art.

What is claimed is:

1. An organic light emitting diode display comprising:

a scan driver for transmitting a plurality of scan signals to a plurality of scan lines;

a gate driver for transmitting a plurality of gate signals to a plurality of gate lines;

a data driver for transmitting a plurality of data signals to a plurality of data lines;

a display unit including a plurality of pixels that are respectively connected to corresponding scan lines, corresponding gate lines, and corresponding data lines, wherein the display unit is configured to display an image by emitting light according to the data signals;

a power supply for supplying a first voltage, a second voltage, and a third voltage to the pixels; and a controller for controlling the scan driver, the gate driver, the data driver, and the power supply, and for generating the data signals and supplying them to the data driver, wherein the pixels respectively include:

an organic light emitting diode;

a first transistor having a gate electrode connected to a first node, and coupled between a first voltage line for supplying the first voltage and an anode of the organic light emitting diode;

a second transistor having a gate electrode connected to a corresponding scan line, and coupled between a corresponding data line and the first node; and a third transistor having a gate electrode connected to a corresponding gate line, and between the anode of the organic light emitting diode and a second voltage line supplying the second voltage, and wherein a voltage of the second voltage line is configured to be varied within a frame period.

2. The organic light emitting diode display of claim 1, wherein a cathode of the organic light emitting diode is connected to a third voltage line for supplying the third voltage, and wherein the second voltage is equal to or less than the third voltage.

3. The organic light emitting diode display of claim 1, wherein a first period in which a gate signal for turning off the third transistor is supplied to the corresponding gate line excludes at least a period during which a scan signal is transmitted with a voltage level causing a data signal to be transmitted from a data line.

4. The organic light emitting diode display of claim 3, wherein, during the first period, a current is transmitted through the first transistor to flow to the organic light emitting diode and the third transistor.

5. The organic light emitting diode display of claim 4, wherein, during the first period, the voltage supplied to the second voltage line is controlled so that a portion of the current flows to the third transistor.

6. A pixel, comprising:

a first voltage supply line connected to a first voltage supply source;

an organic light-emitting diode (OLED) comprising an anode and a cathode electrically connected to a second voltage supply source;

a third voltage supply line connected to a third voltage supply source;

a first transistor electrically connected to the OLED and configured to transmit a driving current to the OLED, a second transistor connected between a data line and a scan line;

a third transistor electrically connected to the first transistor and the third voltage supply line;

a fourth transistor electrically connected between the first transistor and the first voltage supply line;

a fifth transistor electrically connected between the first transistor and the anode of the OLED;

a sixth transistor connected to the third transistor and the third voltage supply line and controlled by a first signal; and a seventh transistor electrically connected to the anode of the OLED, the fifth transistor, and the third voltage supply line, and controlled by a second signal, wherein a portion of the driving current is configured to flow via the turned off seventh transistor.

7. The pixel of claim 6, wherein, while the fourth transistor and the fifth transistor are maintained in a turned-on state, the portion of the driving current is configured to flow via the seventh transistor while the seventh transistor is turned off.

8. The pixel of claim 6, wherein a gate electrode and a source electrode of the seventh transistor are both connected to a node formed between the first transistor and the anode of the OLED.

9. The pixel of claim 6, wherein a gate electrode of the seventh transistor is connected to a DC voltage supply source having a voltage value configured to turn off the seventh transistor.

10. The pixel of claim 6, wherein a gate electrode of the seventh transistor is connected to the scan line, and wherein, while a scan signal transmitted from the scan line is transmitted with a voltage level for turning off the seventh transistor, the portion of the driving current is configured to flow via the seventh transistor while the seventh transistor is turned off.

11. The pixel of claim 6, wherein a gate electrode of the seventh transistor is connected to a previous scan line, and wherein, while the second signal transmitted from the previous scan line is transmitted with a voltage level for turning off the seventh transistor, the portion of the driving current is configured to flow via the seventh transistor while the seventh transistor is turned off.

12. The pixel of claim 6, wherein the third voltage supply source supplies a variable voltage and is configured to supply a DC voltage based on a characteristic of a panel and supply the variable voltage based on a DC voltage level of the DC voltage.

13. The pixel of claim 6, wherein the portion of the driving current is controlled according to a voltage difference between a voltage at an anode electrode of the OLED and a voltage of the third voltage supply line.

14. The pixel of claim 6, wherein, during a black luminance condition for emitting light having a minimum luminance from the OLED, the third voltage supply source is controlled so that the portion of the driving current flows via the seventh transistor while the seventh transistor is turned off.

* * * * *